US007407229B1

(12) United States Patent
Chen

(10) Patent No.: US 7,407,229 B1
(45) Date of Patent: Aug. 5, 2008

(54) RECLINING ROCKING CHAIR

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 11/821,202

(22) Filed: Jun. 22, 2007

(51) Int. Cl.
*A47C 3/02* (2006.01)
*A47C 3/03* (2006.01)
*A47C 1/02* (2006.01)

(52) U.S. Cl. ..... 297/259.2; 297/81; 297/DIG. 7; 297/270.2; 297/270.5

(58) Field of Classification Search ..... 297/259.2, 297/DIG. 7, 270.2, 270.5, 423.26, 271.6, 297/270.3, 80, 81, 82, 30, 32
See application file for complete search history.

(56) References Cited

U.S. PATENT DOCUMENTS 169,772 A * 11/1875 Cadwallader ..... 297/10
2,195,091 A * 3/1940 Lorenz et al. ..... 297/27
D149,926 S * 6/1948 Arndt ..... D6/360
2,508,109 A * 5/1950 Glasco ..... 297/70
2,560,985 A * 7/1951 Rideout ..... 297/82
5,464,270 A * 11/1995 Chang ..... 297/81
6,676,206 B2 * 1/2004 Brandschain ..... 297/32
6,902,231 B1 * 6/2005 Tseng ..... 297/27

* cited by examiner

*Primary Examiner*—Milton Nelson, Jr.
(74) *Attorney, Agent, or Firm*—William E. Pelton, Esq.; Cooper & Dunham LLP

(57) ABSTRACT

A reclining rocking chair has two seat bars, a backrest bar, two armrests, a footrest bar, an adjustment device and two rocker assemblies. The seat bars, backrest bar, armrests and footrest bar connect pivotally to each other. The adjustment device is mounted on one side of the chair and connects to the corresponding seat bar, armrest and footrest bar and has a clamp, an arm post and an adjustment bolt. The clamp is mounted on the armrest. The arm post connects pivotally to the armrest and the footrest bar and is mounted slidably through the clamp. The adjustment bolt is mounted movably through the clamp and selectively presses against the arm post to allow the chair to rock and recline safely.

8 Claims, 8 Drawing Sheets

RECLINING ROCKING CHAIR

BACKGROUND OF THE INVENTION

1. Field of the Invention

The present invention relates to a rocking chair, and more particularly to a reclining rocking chair that has a seat, a backrest and a footrest, wherein the backrest and the footrest may be adjusted and held securely and safely.

2. Description of Related Art

Rocking chairs are generally used at home to allow a person to rock back and forth while they take a rest. Conventional rocking chairs can rock but cannot recline.

Another rocking chair has been developed which can recline. The reclining rocking chair comprises a frame, two rockers and two resilient discs. The frame has two seat bars, each comprising a front and a rear and two U-shaped bars connecting pivotally to both ends of the seat bars to form a seat, a backrest bar, a footrest and four pivot points. The person may change angles between the backrest, footrest and the seat. The rockers are mounted on the frame to provide the rocking motion. The resilient discs are mounted respectively on two pivot points to provide friction between the seat bars and the footrest and backrest bar so that the frame does not pivot inadvertently. However, the friction by the resilient discs is limited so the frame cannot support a heavy person without collapsing. Therefore, the reclining rocking chair is not safe.

To overcome the shortcomings, the present invention provides a reclining rocking chair to mitigate or obviate the aforementioned problems.

SUMMARY OF THE INVENTION

The main objective of the invention is to provide a reclining rocking chair that has a seat, a backrest bar and a footrest, wherein the angular positions of the backrest and the footrest relative to the seat may be adjusted and held securely without inadvertently pivoting.

A reclining rocking chair further comprises two seat bars, two armrests, an adjustment device and two rocker assemblies. The seat bars, backrest bar, armrests and footrest connect pivotally to each other. The adjustment device is mounted on one side of the chair and connects to the corresponding seat bar, armrest and footrest and has a clamp, an arm post and an adjustment bolt. The clamp is mounted on the armrest. The arm post connects pivotally to the armrest and the footrest and is mounted slidably through the clamp. The adjustment bolt is mounted movably through the clamp and selectively presses against the arm post to allow the chair to rock and recline safely.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
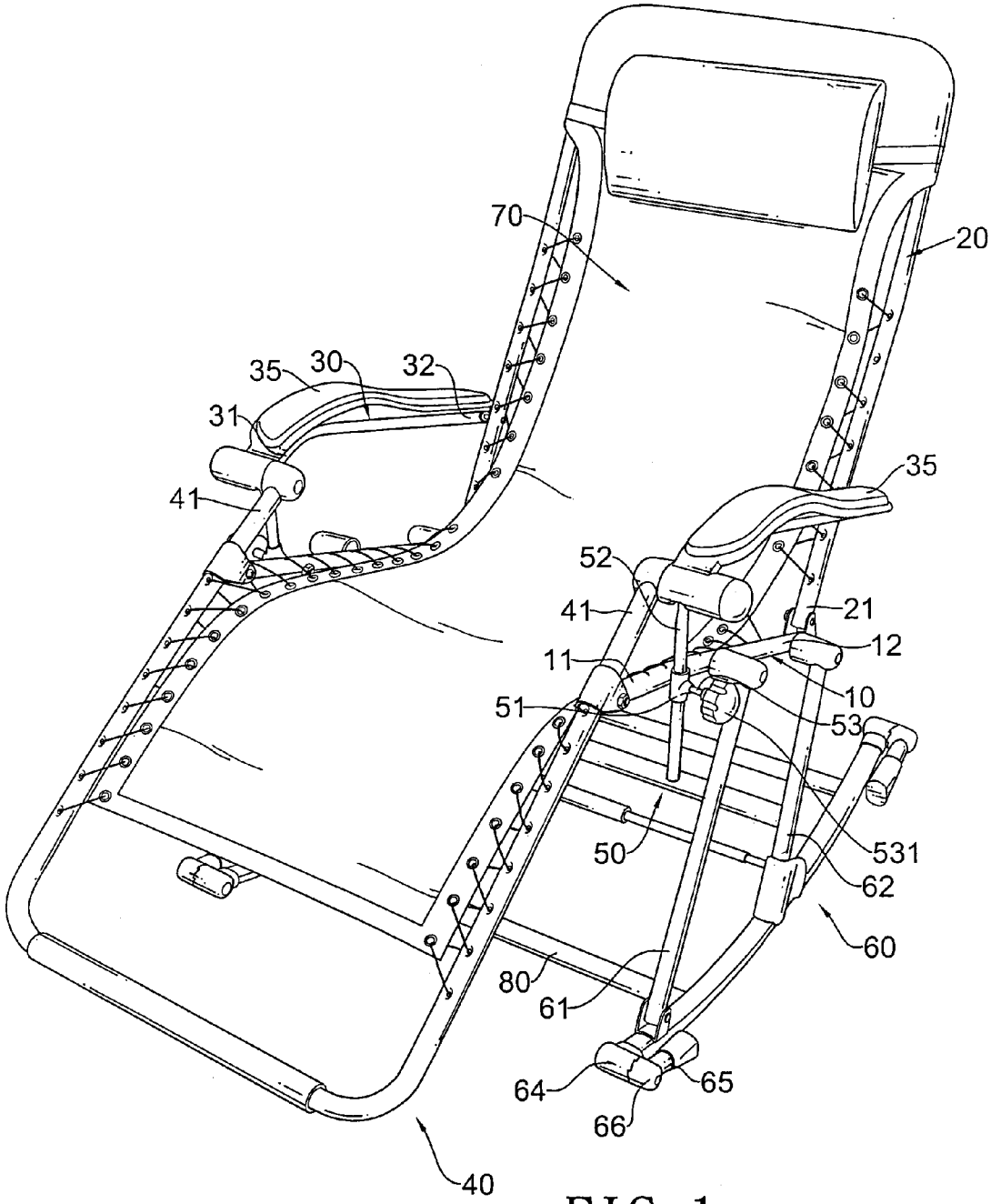
FIG. 1 is a perspective view of a reclining rocking chair in accordance with the present invention.

With reference to FIG. 1, a reclining rocking chair in accordance with the present invention comprises two seat bars (10), a backrest bar (20), two armrests (30), a footrest bar (40), an adjustment device (50), a cushion (70) and two rocker assemblies (60) and may further have at least one stretcher (80).

The seat bars (10) are parallel to each other. Each seat bar (10) has a front end (11) and a rear end (12).

The backrest bar (20) is U-shaped and has two side bars. The side bars correspond respectively to the seat bars (10) and each side bar has a lower end (21). The lower end (21) connects pivotally to the rear end (12) of a corresponding seat bar (10). The armrests (30) are longitudinal bars, respectively connect pivotally to the side bars of the backrest bar (20) and each armrest (30) has a front end (31), a rear end (32) and may further have a pad (35). The rear end (32) of the armrest (30) connects pivotally to a corresponding side bar of the backrest bar (20) near the lower end (21). The pad (35) is a resilient cushion mounted on the armrest (30).

The footrest bar (40) is U-shaped and has two side bars. The side bars of the footrest bar (40) correspond respectively to the seat bars (10), correspond respectively to the armrest bars (30) and each side bar has an upper end (41) and an intermediate section. The upper end (41) of the side bar of the footrest bar (40) connects pivotally to the front end (31) of a corresponding armrest (30). The intermediate section of the side bar of the footrest bar (40) is defined near the upper end (41) and connects pivotally to the front end (11) of a corresponding seat bar (10).

Figure 2A:
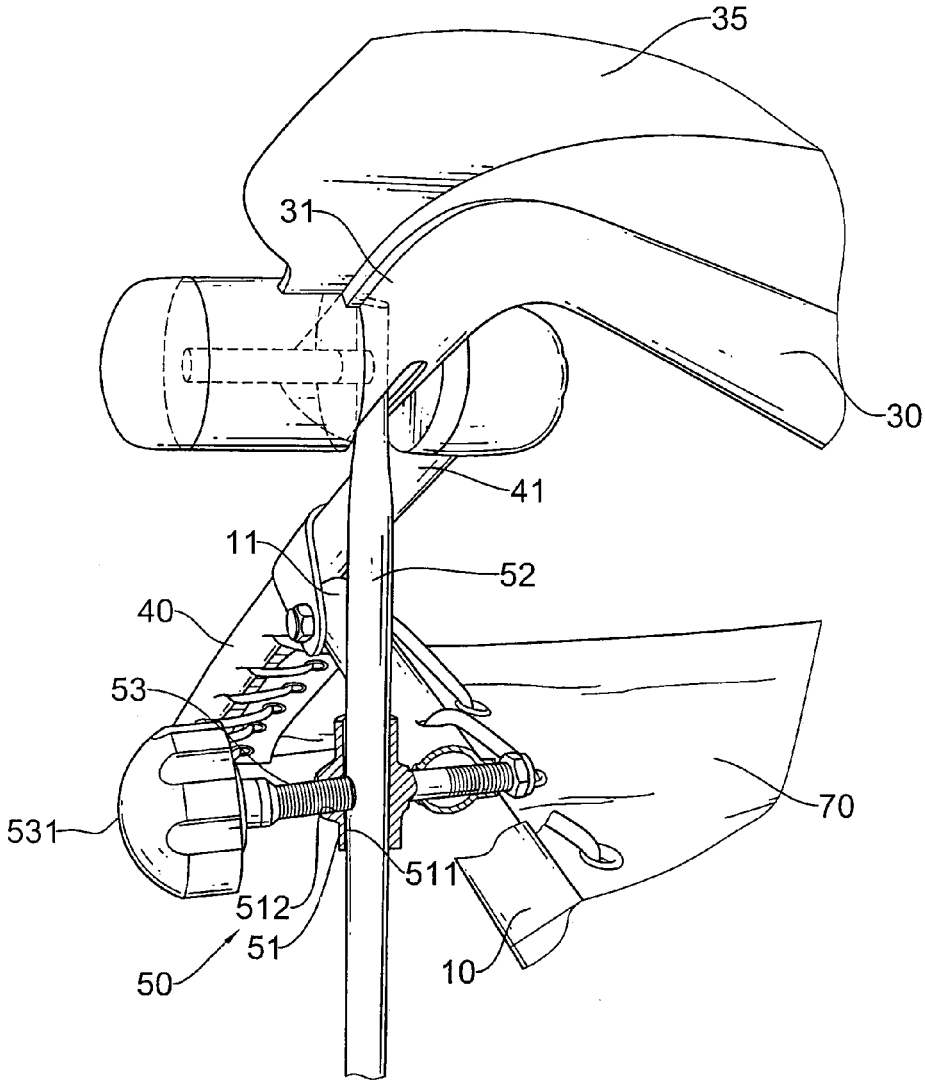
FIG. 2A is an enlarged perspective view in partial section of an adjustment device of the reclining rocking chair in FIG. 1.
Figure 2B:
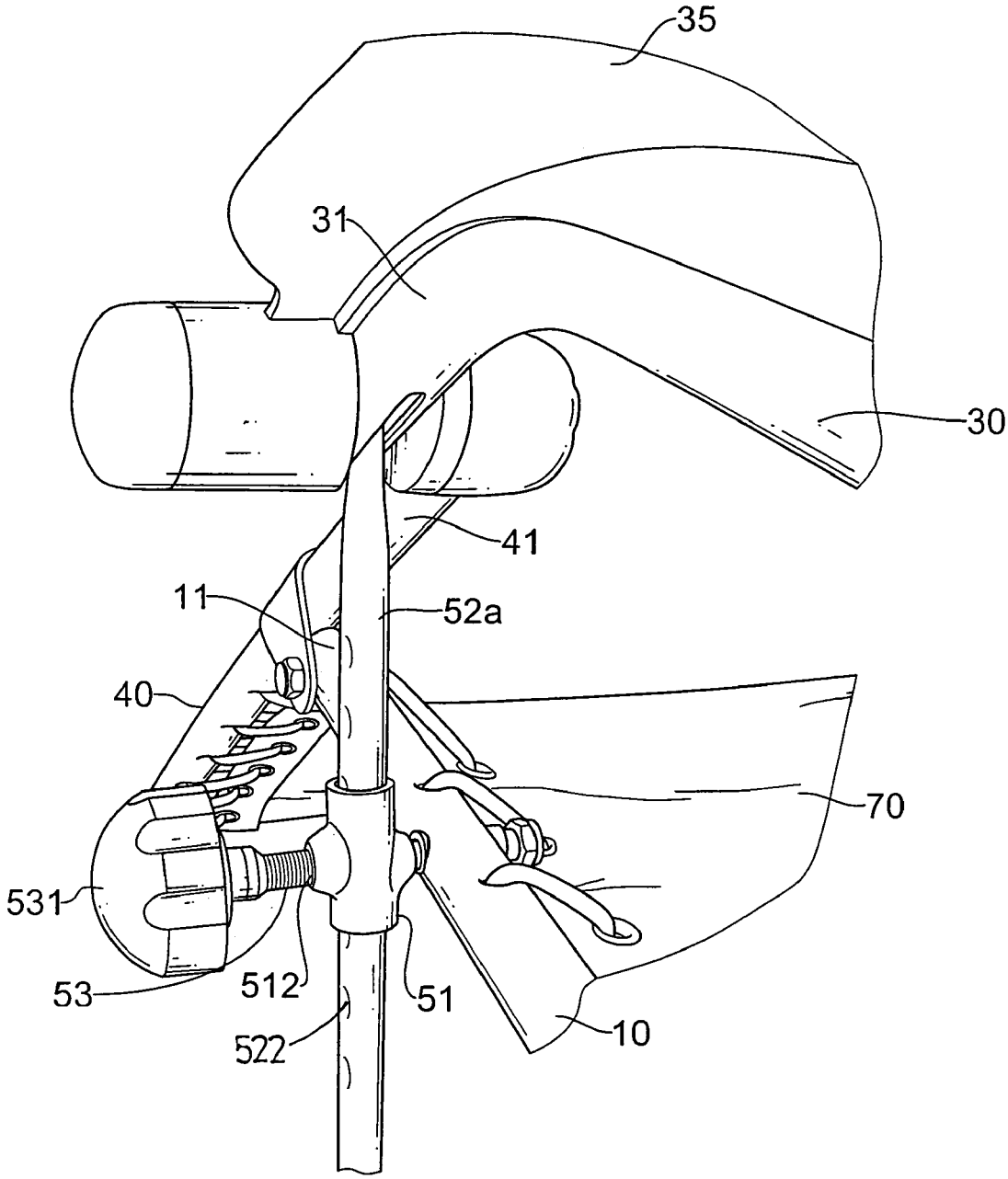
FIG. 2B is an enlarged perspective view of the adjustment device of the reclining rocking chair in FIG. 1 arm post with a row of detents.

With reference to FIGS. 2A and 2B, the adjustment device (50) connects to and corresponds to one of the seat bars (10), one of the armrests (30) and one of the side bars of the footrest bar (40). The adjustment device (50) comprises a clamp (51), an arm post (52, 52*a*) and an adjustment bolt (53).

The clamp (51) is mounted pivotally on a corresponding armrest (30) and has a through hole (511) and a threaded hole (512). The through hole (511) is defined longitudinally through the clamp (51). The threaded hole (512) is defined transversely in the clamp (51) and communicates with the through hole (511).

The arm post (52, 52*a*) connects pivotally to the front end (31) of the corresponding armrest (30) and the upper end (41) of a corresponding side bar of the footrest bar (40) and is mounted slidably through the through hole (511) of the clamp (51). The arm post (52*a*) further, preferably comprises a row of detents (522) defined in the arm post (52*a*).

Figure 3:
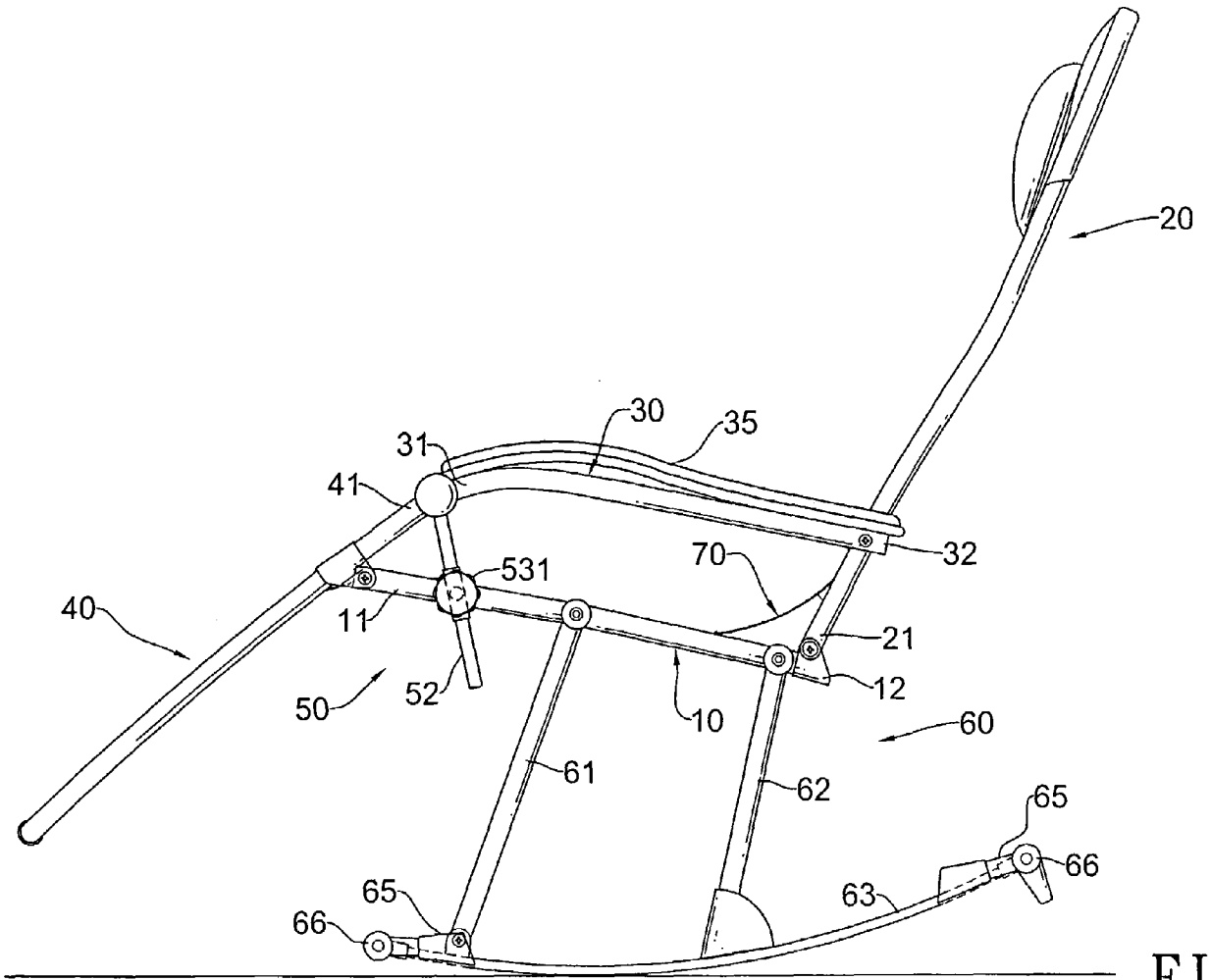
FIG. 3 is a side view of the reclining rocking chair in FIG. 1.
Figure 4:
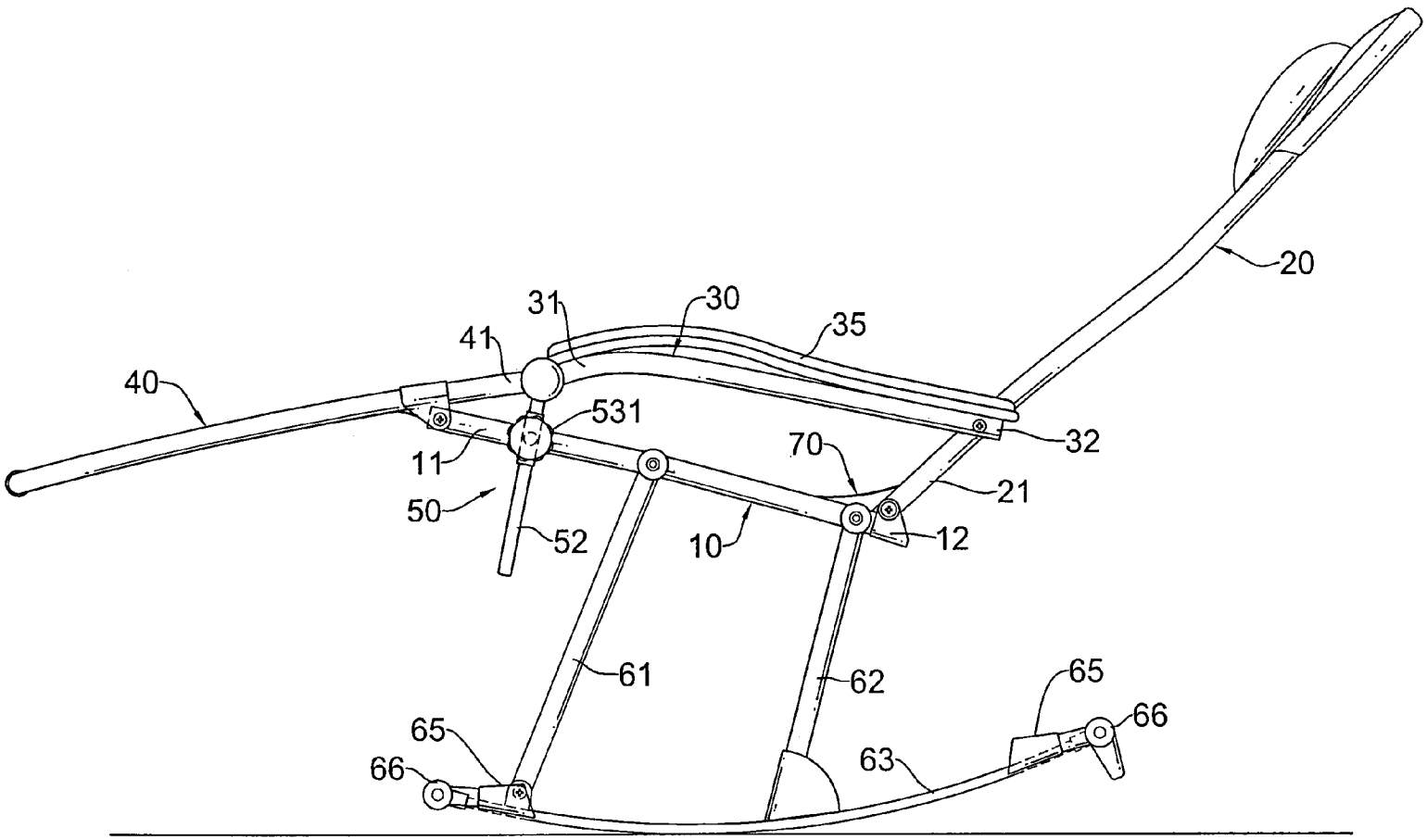
FIG. 4 is an operational side view of the reclining rocking chair in FIG. 3, shown reclined.

With further reference to FIGS. 3 and 4, the adjustment bolt (53) is mounted rotatably and movably through the threaded hole (512) in the clamp (51), and has an outer end, an inner end and may further have a knob (531). The inner end selectively presses tightly against the arm post (52) and may selectively engage with the one of the detents (522) of the arm post (52*a*) to prevent further movement. The knob (531) is mounted on the outer end of the adjustment bolt (53) and allows a person to easily rotate the adjustment bolt (53). When the adjustment bolt (53) is released, the person may adjust angular positions of the backrest bar (20) and the footrest bar (40) relative to the seat bars (10). When the adjustment bolt (53) presses against the arm post (52, 52*a*), the backrest bar (20) and the footrest bar (40) are held securely so the reclining rocking chair cannot collapse.

The cushion (70) is soft, may be made of plastic, rubber, cotton, silk or the like, is mounted on the seat bars (10), the backrest bar (20) and the footrest bar (40) to form a seat, a backrest and a footrest.

The rocker assemblies (60) connect respectively to and correspond respectively to the seat bars (10) and each rocker assembly (60) has multiple legs (61, 62) and a rocker (63) and may further have two feet (65) and two unidirectional connectors.

The legs (61, 62) connect to a corresponding seat bar (10).

The rocker (63) connects to the legs (61, 62) and has a front end and a rear end.

The feet (65) are mounted respectively on the front end and the rear end of the rocker (63) and are selectively rotated to stand to prevent the rocker (63) from rocking. Each foot (65) has a proximal end and a distal end.

Figure 5:
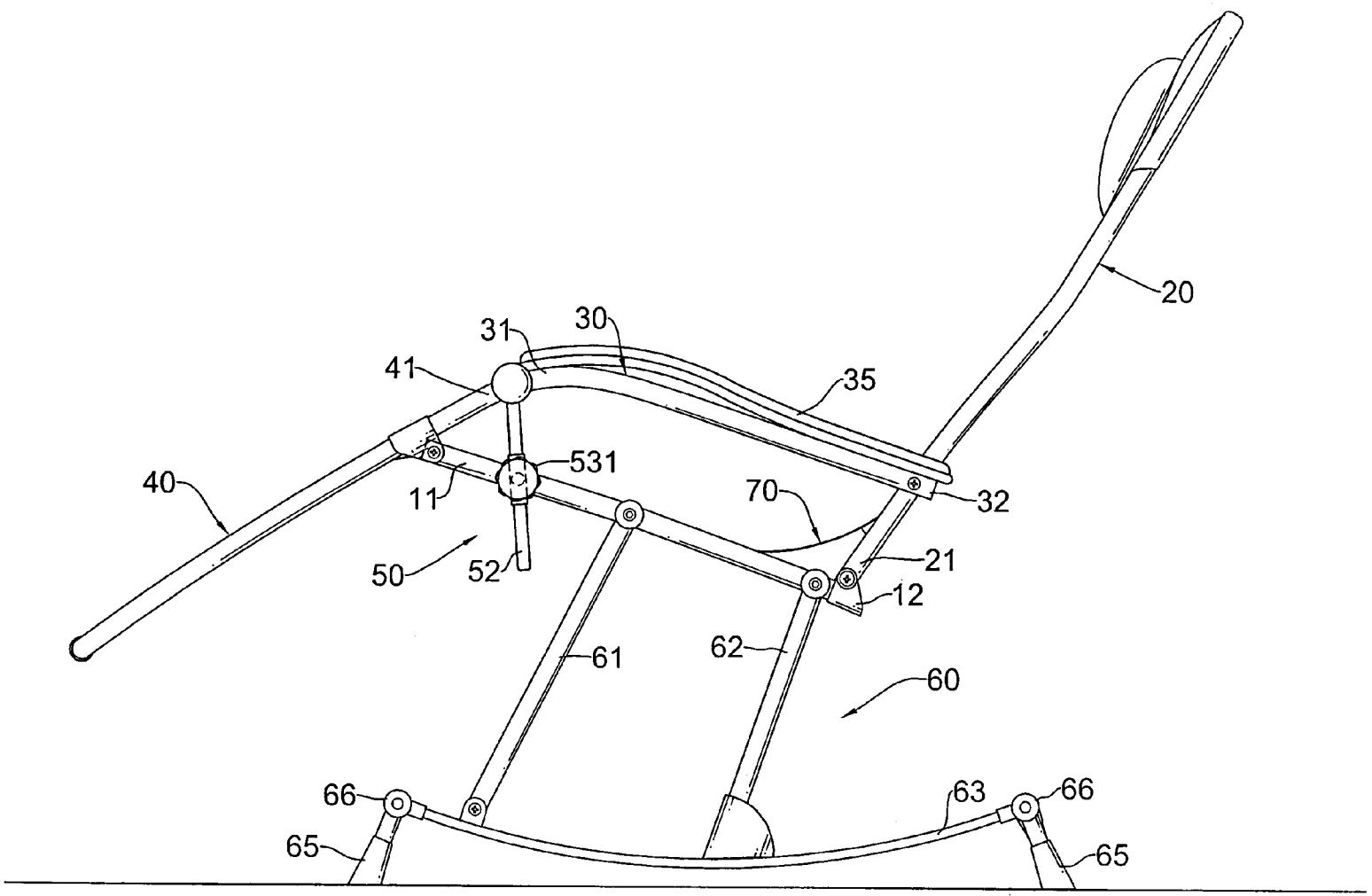
FIG. 5 is an operational side view of the reclining rocking chair in FIG. 3 with the feet of the rocker assembly pivoting down to stand on a floor.
Figure 6A:
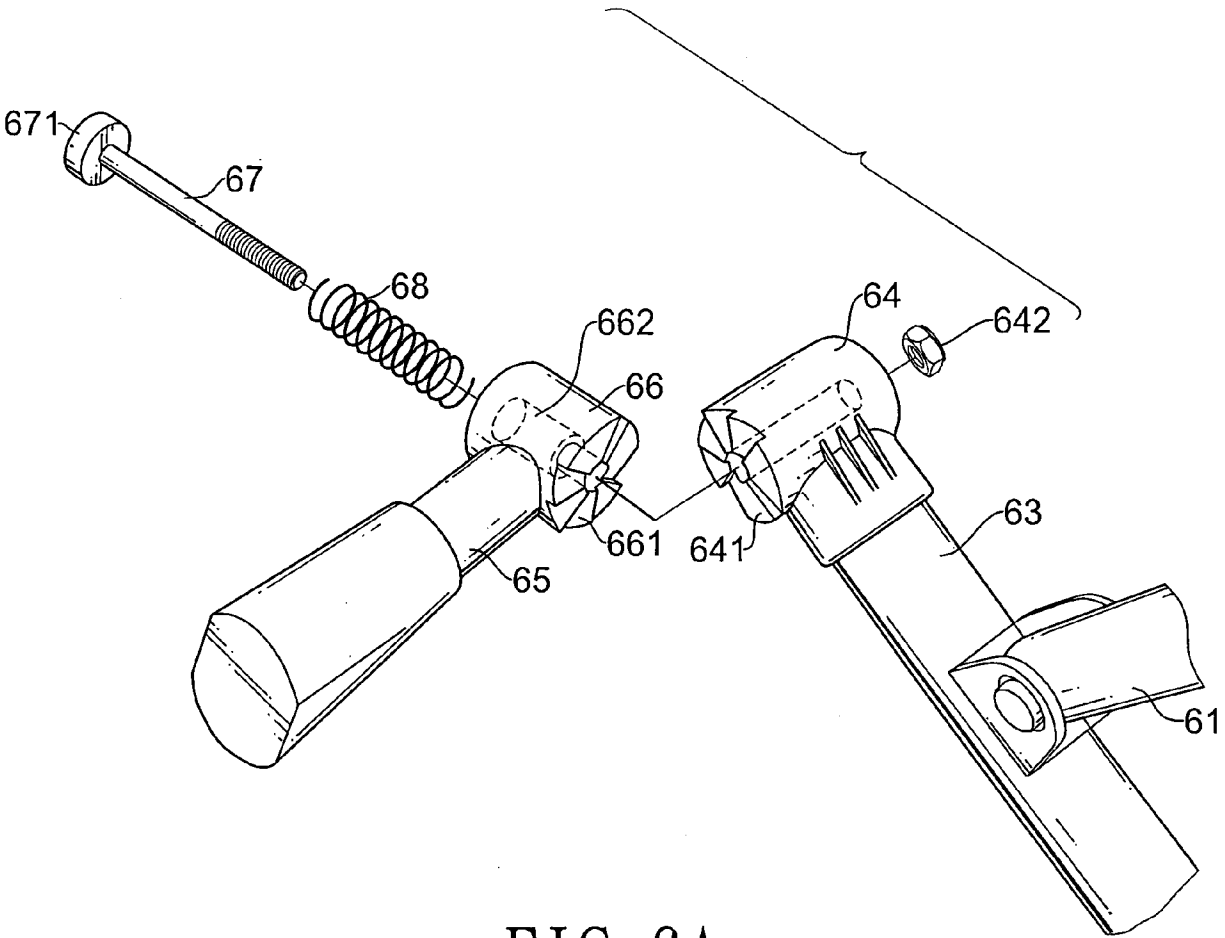
FIG. 6A is an exploded perspective view of a front foot in FIG. 5.
Figure 6B:
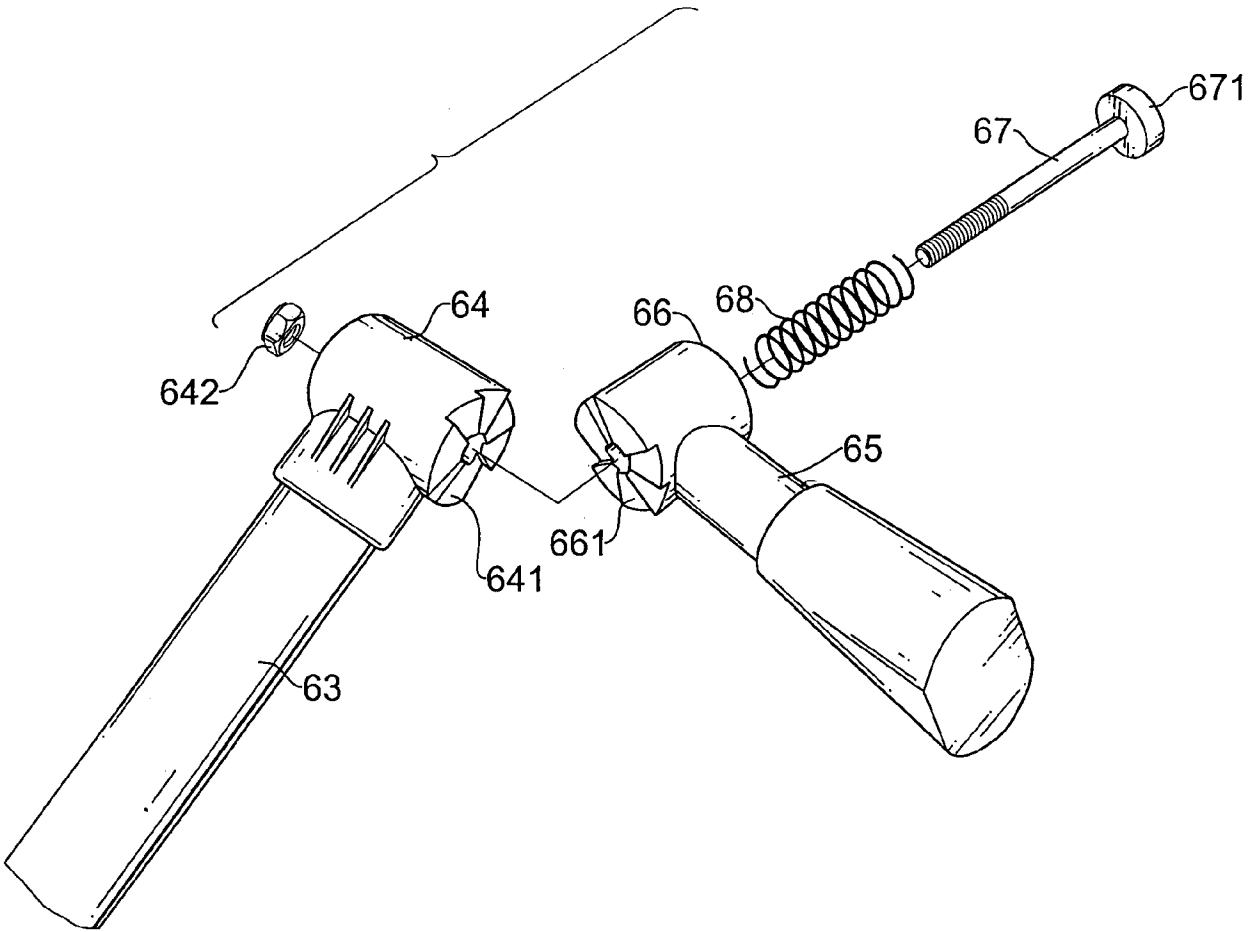
FIG. 6B is an exploded perspective view of a rear foot in FIG. 5.

With reference to FIGS. 5, 6A and 6B, the unidirectional connectors are mounted on the rocker (63), correspond respectively to the feet (65), correspond respectively to the front end and the rear end of the rocker (63), connect the feet (65) respectively to the front end and the rear end of the rocker (63) and selectively hold or rotate the feet (65). Each unidirectional connector limits a corresponding foot (65) to be capable of rotating in only one rotational direction. Furthermore, the rotational directions in which the feet (65) on the rocker (63) are capable of rotating are opposite. Therefore, when the rocker is held stationary, the foot (65) on the rear end of the rocker (63) is forced counterclockwise, and the foot (65) on the front end of the rocker (63) is forced clockwise so the unidirectional connector on the foot (65) at the front end allows clockwise rotation and the unidirectional connector on the foot (65) at the rear end allows counterclockwise rotation. Each unidirectional connector may comprise an inner cylinder (64), a nut (642), an outer cylinder (66), a mounting bolt (67) and a compression spring (68).

The inner cylinder (64) is a ratchet, is mounted on a corresponding one of the front and rear ends of the rocker (63) and has an outer face, a central hole, multiple ratchet teeth (641) and may comprise a countersink (662). The central hole is defined through the inner cylinder (64). The ratchet teeth (641) are formed on the outer face around the central hole.

The outer cylinder (66) is a ratchet, is mounted on the proximal end of the corresponding foot (65) and has an outer face, an inner face, a central hole, a countersink (662) and multiple ratchet teeth (661). The central hole is defined through the outer cylinder (66). The countersink (662) is defined in the outer face of the outer cylinder (66) and communicates concentrically with the central hole in the outer cylinder (66). The ratchet teeth (661) are formed on the inner face of the outer cylinder (66) and selectively engage respectively with the ratchet teeth of the inner cylinder (64).

The mounting bolt (67) is mounted slidably through the central holes of the cylinders (66, 64), is held securely by the nut (642) and has an enlarged head (671).

The compression spring (68) is mounted around the mounting bolt (67) and in the countersink (662), presses against the enlarged head (671) and engages the inner cylinder (64) with the outer cylinder (66).

Furthermore, each rocker (63) may further has a limit mounted at the rear of the rocker (63) to prevent the reclining rocking chair from over rotating and falling backwards.

The at least one stretcher (80) is mounted between the rockers (63).

The adjustment device (50) holds the backrest bar (20) and the footrest bar (40) securely at variable angles relative to the seat bars (10) so that the reclining rocking chair can recline stably. Furthermore, the feet (65) may selectively prevent the rocker assemblies (60) from rocking.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A reclining rocking chair comprising two seat bars being parallel to each other, and each seat bar having a front end and a rear end;

a backrest bar being U-shaped and having two side bars respectively connecting pivotally to the seat bars and each side bar having a lower end;

two armrests respectively connecting pivotally to the side bars of the backrest bar and each armrest having a front end; and a rear end connecting pivotally to a corresponding side bar of the backrest bar near the lower end;

a footrest bar being U-shaped and having two side bars corresponding respectively to the seat bars and the armrests and each side bar of the footrest bar having an upper end connecting pivotally to the front end of a corresponding armrest; and an intermediate section defined near the upper end and connecting pivotally to the front end of a corresponding seat bar;

an adjustment device connecting to and corresponding to one of the seat bars, one of the armrests and one of the side bars of the footrest bar, and having a clamp being mounted pivotally on a corresponding armrest and having a through hole defined longitudinally through the clamp; and a threaded hole defined transversely in the clamp and communicating with the through hole;

an arm post connecting pivotally to the front end of the corresponding armrest and the upper end of a corresponding side bar of the footrest bar and mounted slidably through the through hole of the clamp; and an adjustment bolt mounted rotatably and movably through the threaded hole in the clamp, and having an outer end and an inner end selectively pressing tightly against the arm post;

a cushion mounted on the seat bars, the backrest bar and the footrest bar to form a seat, a backrest and a footrest; and two rocker assemblies connecting respectively to and corresponding respectively to the seat bars and each rocker assembly having multiple legs connecting to a corresponding seat bar; and a rocker connecting to the legs and having a front end and a rear end.

2. The reclining rocking chair as claimed in claim 1, wherein:

the arm post of the adjustment device further comprises multiple detents defined in the arm post; and the inner end of the adjustment bolt selectively engages with one of the detents in the arm post.

3. The reclining rocking chair as claimed in claim 2, wherein each rocker assembly further has two feet mounted respectively on the front end and the rear end of the rocker, selectively rotated to stand to prevent the rocker from rocking, and each foot having a proximal end and a distal end; and two unidirectional connectors mounted on the rocker corresponding respectively to the feet, corresponding respectively to the front and rear ends of the rocker, connecting the feet respectively to the front and rear ends of the rocker, selectively holding or rotating the feet and each unidirectional connector limiting a corresponding foot to be capable of rotating in only one rotational direction.

4. The reclining rocking chair as claimed in claim 3, wherein each unidirectional connector has an inner cylinder mounted on a corresponding one of the front and rear end of the rocker and having an outer face;

a central hole defined through the inner cylinder;

multiple ratchet teeth formed on the outer face around the central hole; and an outer cylinder mounted on the proximal end of the corresponding foot and having an outer face;

an inner face;

a central hole defined through the outer cylinder;

a countersink defined in the outer face of the outer cylinder; and multiple ratchet teeth; and a mounting bolt mounted slidably through the central holes of the cylinders, and having an outer end and an enlarged head formed on the outer end; and a nut securely holding the mounting bolt;

a compression spring mounted around the mounting bolt and in the countersink, pressing against the enlarged head and engaging the inner cylinder with the outer cylinder.

5. The reclining rocking chair as claimed in claim 4, wherein the rotational directions in which the feet on the rocker are capable of rotating are opposite.

6. The reclining rocking chair as claimed in claim 5 further comprising at least one stretcher mounted between the rockers.

7. The reclining rocking chair as claimed in claim 6, wherein each of the armrests further has a pad being a resilient cushion mounted on the armrest.

8. The reclining rocking chair as claimed in claim 6, wherein the adjustment bolt further has a knob mounted on the adjustment bolt.

* * * * *